US007083559B2

(12) United States Patent
Castello et al.

(10) Patent No.: US 7,083,559 B2
(45) **Date of Patent: *Aug. 1, 2006**

(54) METHOD FOR MAKING CHANGEABLE PICTURE WITH MOVABLE MEMBERS UTILIZING WEB FED PRINTING PROCESS

(75) Inventors: Rodney A. Castello, Studio City, CA (US); Sanford K. Otsuji, Mission Viejo, CA (US); James D. Richwine, Santa Monica, CA (US)

(73) Assignee: Structural Graphics, Essex, CT (US)

( * ) Notice: Subject to any disclaimer, the term of this patent is extended or adjusted under 35 U.S.C. 154(b) by 4 days.

This patent is subject to a terminal disclaimer.

(21) Appl. No.: 10/856,480

(22) Filed: Jun. 1, 2004

(65) Prior Publication Data

US 2005/0274471 A1 Dec. 15, 2005

(51) Int. Cl.
*B31B 1/26* (2006.01)

(52) U.S. Cl. ..... 493/405; 493/194; 493/231; 493/264; 493/408; 40/124.09; 40/436; 40/445; 156/227; 156/250; 156/277

(58) Field of Classification Search ..... 493/405, 493/408, 409, 194, 231, 264; 40/124.09, 40/124.12, 124.13, 436, 445; 156/227, 250, 156/277, 291; 428/121, 136; 446/149, 151
See application file for complete search history.

(56) References Cited

U.S. PATENT DOCUMENTS

| | | | | | |
|---|---|---|---|---|---|
| 850,150 | A * | 4/1907 | Glazier | 446/146 |
| 3,946,508 | A * | 3/1976 | Booras | 40/124.06 |
| 5,112,290 | A * | 5/1992 | Hibsch | 493/325 |
| 5,141,253 | A * | 8/1992 | Rice | 283/65 |
| 5,259,133 | A * | 11/1993 | Burtch | 40/124.08 |
| 5,450,680 | A * | 9/1995 | Bromberg | 40/124.08 |
| 5,492,522 | A * | 2/1996 | Rubar | 493/325 |
| 5,746,689 | A * | 5/1998 | Murphy | 493/397 |
| 5,759,328 | A * | 6/1998 | Richwine et al. | 156/227 |
| 5,778,578 | A * | 7/1998 | Drapcho et al. | 40/491 |
| 5,833,789 | A * | 11/1998 | Rosendale et al. | 156/227 |
| 6,513,270 | B1 * | 2/2003 | Mackenzie | 40/124.08 |

* cited by examiner

*Primary Examiner*—Stephen F. Gerrity
*Assistant Examiner*—Hemant M. Desai
(74) *Attorney, Agent, or Firm*—Gerald L. Price

(57) ABSTRACT

A novelty piece fabricated from a continuous roll of paper, with indicia applied to both sides. Fold lines and cut lines are provided at predetermined positions. The sheet is scored and die-cut, and an adhesive is applied at pre-selected locations. The paper is folded in thirds, and is cut again to produce the final product. In operation, the completed product has sliding panels that reveal hidden indicia, both in moveable panels and in apertures. The aforstated features can apply to both sides of the novelty piece.

5 Claims, 11 Drawing Sheets

METHOD FOR MAKING CHANGEABLE PICTURE WITH MOVABLE MEMBERS UTILIZING WEB FED PRINTING PROCESS

DESCRIPTION OF THE PRIOR ART

Novelty pieces are well known as low cost prizes or trade stimulators in the prior art. Such pieces have been, and even currently may be found as prizes in cereal and snack foods, as well as being utilized in merchandising and advertising programs.

SUMMARY OF THE INVENTION

It is an object of this invention to provide a novelty piece which has a movable, changeable display, where upon pulling out a tab, previously covered indicia is revealed on a pulled out member, and/or in a aperture on the body of the piece itself. This can be accomplished on both sides of the product if so desired.

It is another object of this invention to provide a method for making a plurality of the pieces of the foregoing object utilizing web fed printing equipment to enable the preferred embodiment to be economically fabricated.

These and other objects are preferably accomplished by providing a novelty piece cut from web fed paper or other printable substrate having both sides of the sheet printed with indicia in registration and then progressively cutting and perforating at predetermined locations, stripping out selected paper areas, then applying adhesive at pre-selected locations and the sheet is then folded aligning the adhesive locations and the pieces are cut out. The final piece consists of three layers of paper or other printable substrate, the middle of which is covered or hidden until, being revealed by pulling out of tabs on the side(s) of the product, the number of sides can vary from one to many, depending on the shape, and overall size of the finished product, the size of the pull outs, and the application it is produced for. Still another aspect of the final piece is that images that appear in apertures on either side of the product can have the image change by the movement of the slide out middle layer. The middle layer can pull all of the way out and be removed, or it can be set to stop at a predetermined location.

A previous patent U.S. Pat. No. 5,833,789 discloses a novelty piece having a plurality of indicia bearing panels which fold to reveal concealed indicia while the present invention discloses a member which is slide-able to reveal concealed indicia on both the slide-able member, and apertures in the novelty piece itself.

Another important object of the invention is that the within method of producing the novelty piece can be performed on conventional roll fed or web type printing presses, eliminating costly hand labor or specialized machinery, and that the resulting novelty piece is ready to be used with no further fabrication or tearing of edges or the like by the ultimate user.

DESCRIPTION OF THE PREFERRED EMBODIMENT

Figure 1:
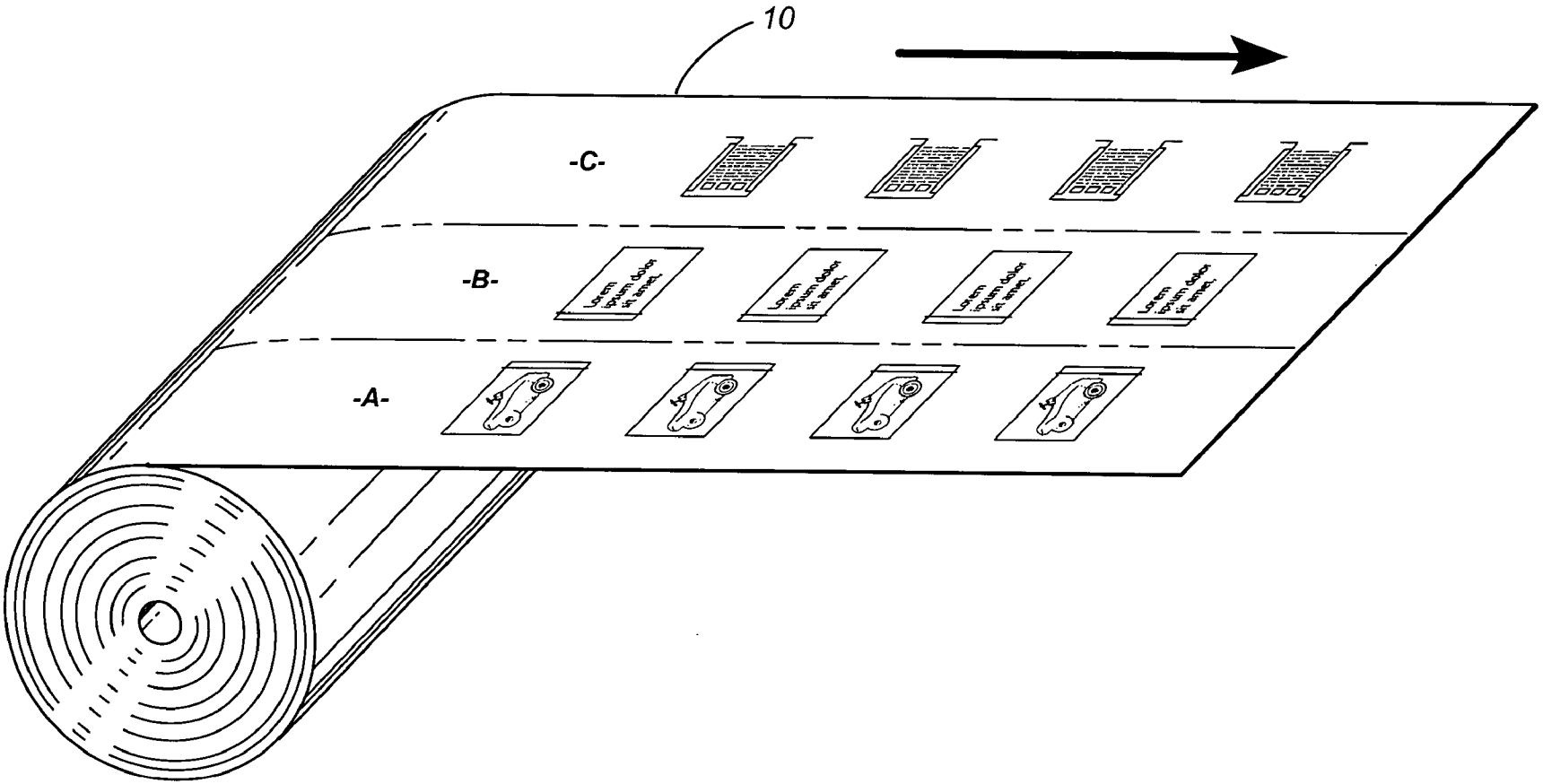
FIG. 1 is a plan view of a front of the sheet of printable substrate having three areas of indicia applied, (rows A, B and C) as well as illustrating where die-cuts and perforations are to be placed.

Referring now to FIG. 1 of the drawing, a sheet 10 of printable substrate is shown having a plurality of vertical rows of indicia A, B, and C applied thereon. As the sheet advances through a sheet fed printing press, each row has been provided with a plurality of images thereon, all the images in one row, as for example, row B, are here depicted as being identical. Thus, three different faces or images are shown in FIG. 1. It is to be understood that all the designs or scenes in one row, such as row B, are only identical if all novelty pieces produced from the same sheet are to be the same. Although the term "sheet" has been used, sheet 10 may be a multi-layered or a multi-plied sheet with the indicia printed separately on two single sheets of paper, then glued, laminated or otherwise joined to a stiffer sheet of, for example, paper or cardboard.

Figure 2:
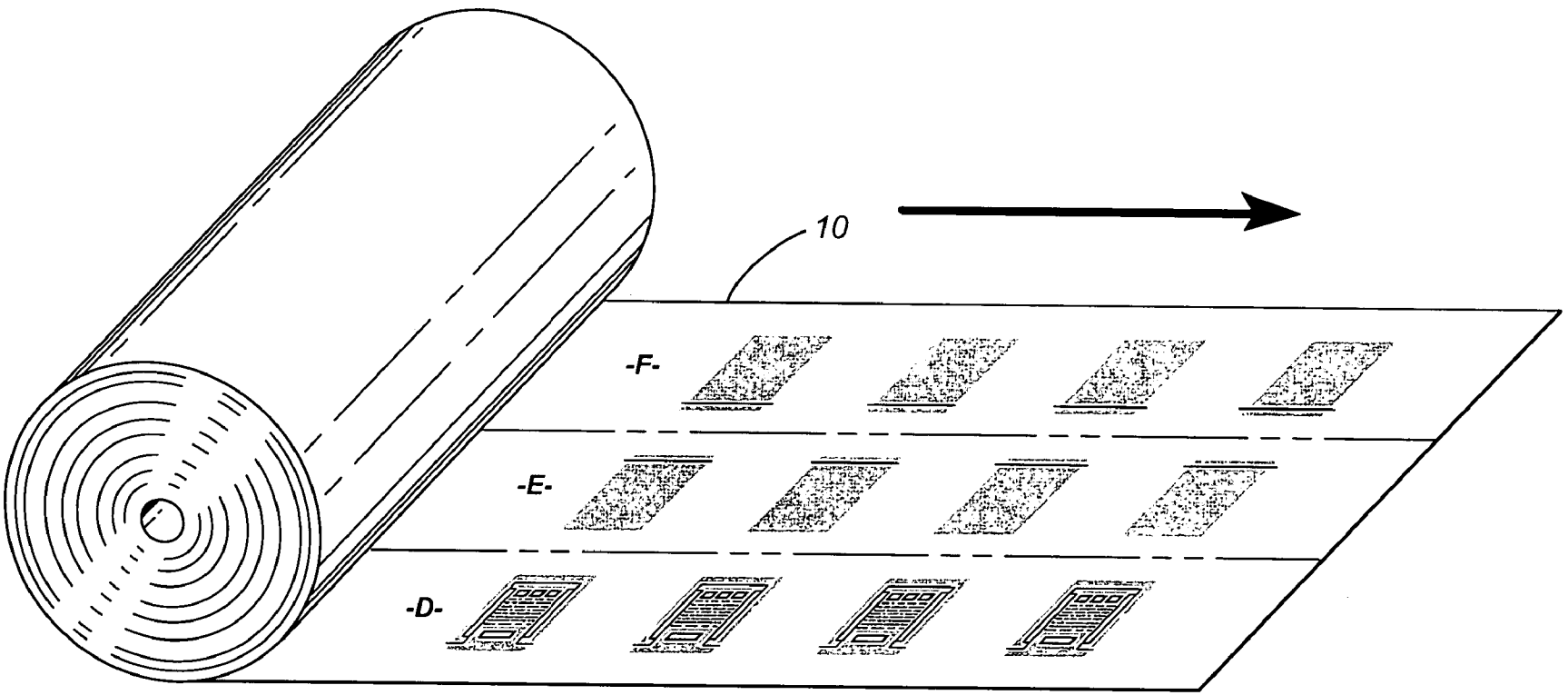
FIG. 2 is a plan view of the back of the sheet of printable substrate having one area of printing (rows D, E, and F) as well as illustrating where die-cuts and perforations can be placed.

Referring now to FIG. 2, the opposite side of sheet 10, is shown, comprising a plurality of vertical rows of indicia D, E, and F which are in alignment and registration with the vertical rows of indicia A, B and C on the front side of sheet 10, shown in FIG. 1.

Sheet 10 thus includes thereon, six faces, designs, indicia, or scenes that can be displayed in the single novelty piece of the instant invention.

As seen by referring collectively to in FIGS. 2 through 6, a plurality of vertical and horizontal die cuts are made through sheet 10 at predetermined locations.

Figure 3A:
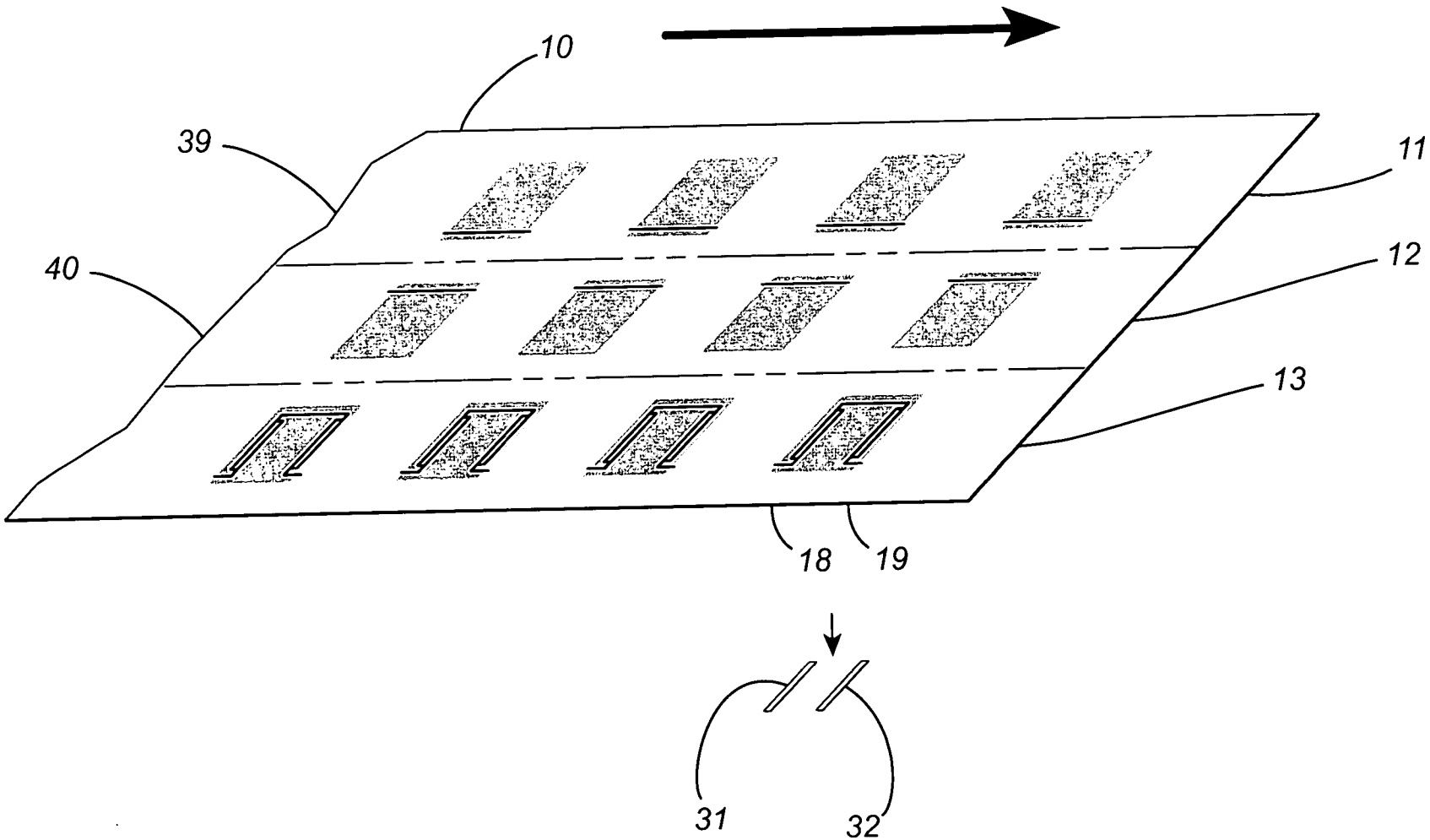
FIG. 3A is a plan view of the front side of the sheet of FIG. 1, without indicia illustrating intended die-cut areas.
Figure 3B:
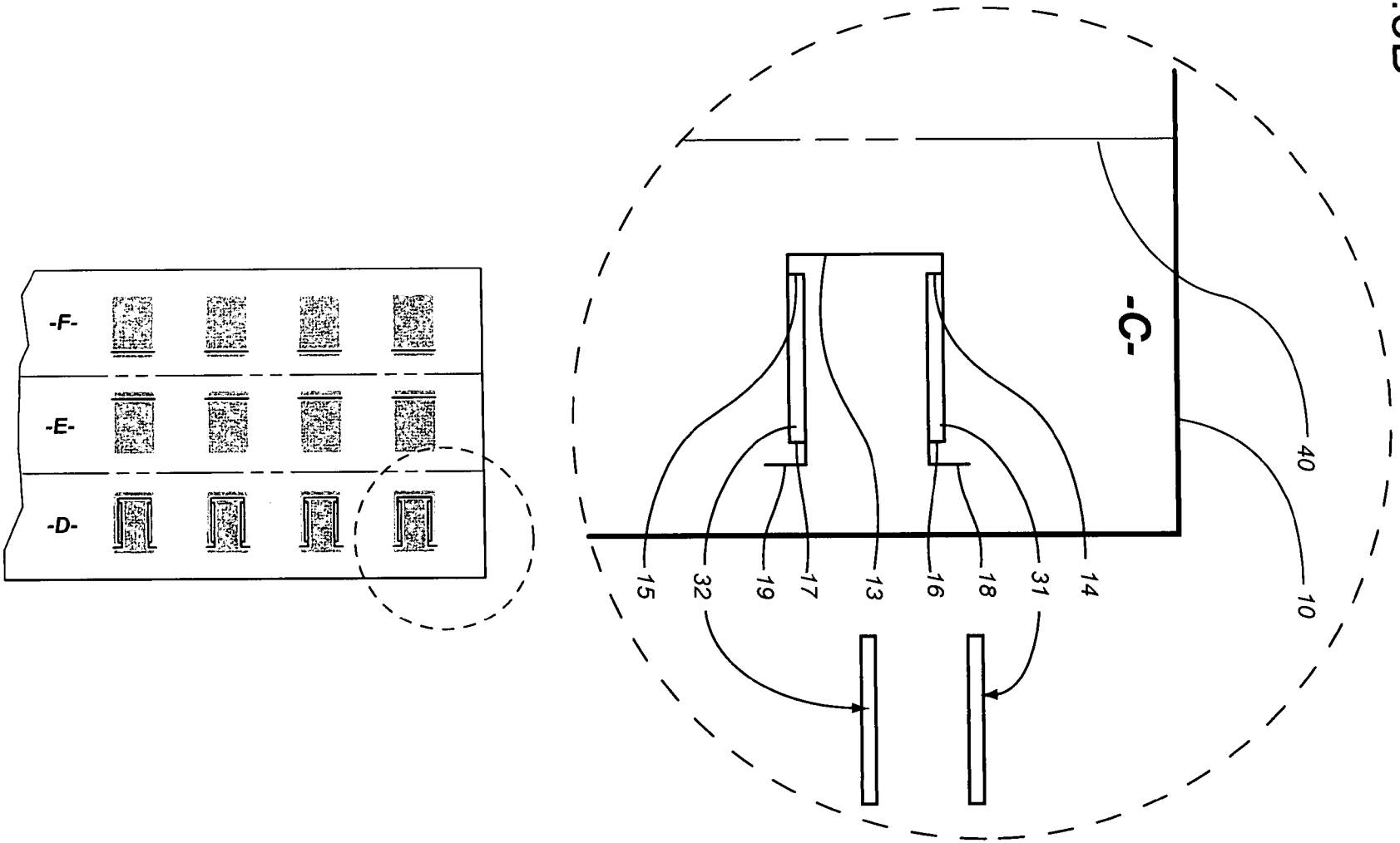
FIG. 3B illustrates the detailed view of die-cut areas.

Referring to FIG. 3 of the drawing, vertical die cuts 11 and 12 are made through the images on rows A through F with rows E and F not being visible inasmuch as they underlie rows A and B and are in alignment and registration therewith. Vertical and horizontal die-cuts 13, 18 and 19 are made in rows C and D with row D not being visible inasmuch as it underlies row C in alignment and registration therewith. The rectangular die cut areas 31 and 32 are physically removed from the printable substrate. The aforestated die cutting and substrate removal allows the aforestated sliding panels when moved, to reveal hidden indicia. The length of the removed material determines the distance that the sliding panels can move. As shown in FIG. 3, when vertical die cuts 14 and 15 advance to vertical die cuts 16 and 17, the moving panel will stop. Some of the time the design will call for the movable panels to stop, which usually means they will be pushed back in again, alternatively, the intended design purpose may have the sliding panels removed completely from the overall piece, in which case vertical die cuts 14 and 15 will not be required. The die cut lines 11, 12, 18 and 19 may extend beyond the edges of each image and accordingly, in production, the die cuts may extend past the final trim size of the piece as shown FIG. 3.

To accomplish the fabrication of the within novelty piece as sheet 10 progresses through a sheet fed printing press, sheet 10 must be folded twice along two fold lines 39, and 40 (FIG. 3*a*) so that the indicia on rows C, D, E and F appear to the inside and the indicia in rows A and B being outside the fold are visible. The inside surfaces of the folded sheet must first be glued or otherwise adhesively affixed so when the sheet 10 is folded about lines 39, and 40 rows A, B, and C which are in alignment and registration with rows D, E, and F will now all be in alignment and registration.

Figure 4:
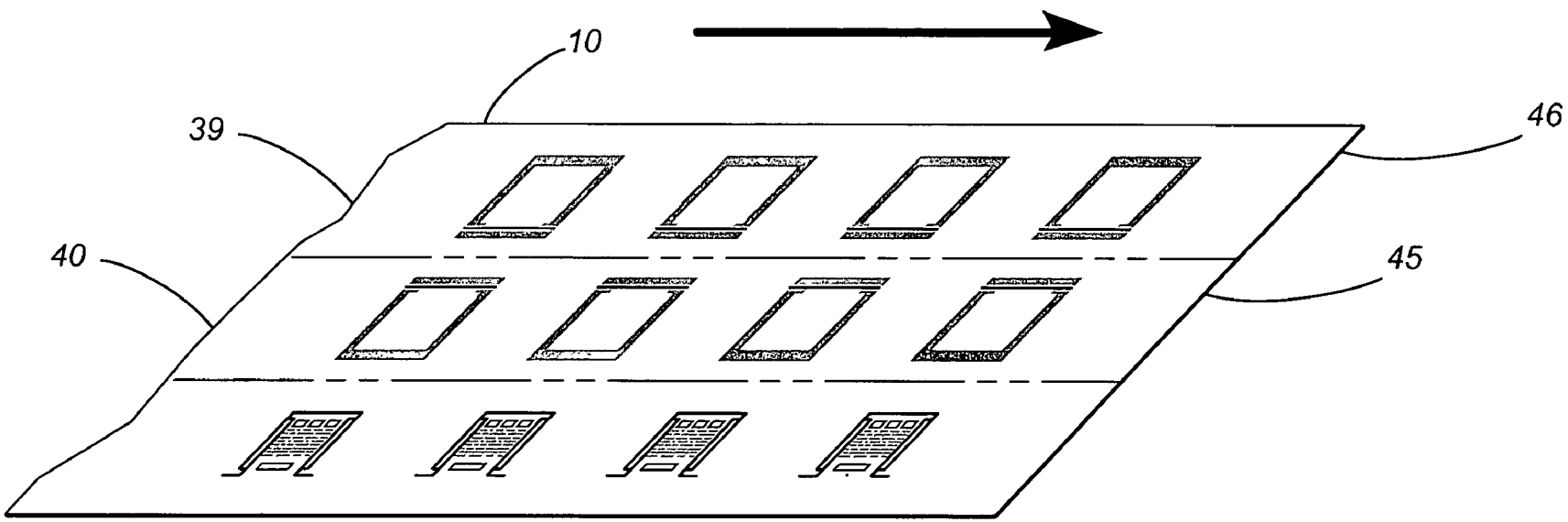
FIG. 4 is a plan view of the front side of the sheet of FIG. 1, here illustrating glue positions.

To accomplish the aforestated gluing in carrying out the instant invention, the glue or other suitable adhesive must be accurately applied at predetermined locations. As shown in FIG. 4, glue patterns, 45 and 46 are applied to specific areas of each image on rows E, and F, prior to the aforestated folding about fold lines 39 and 40, and upon folding, the mating glue pattern areas 47, and on FIG. 5*a* and FIG. 5*b* mating glue pattern area 48 on rows C and D are in registration. The glue may be machine-applied by a number of well-known techniques utilizing templates, special fixtures or printing technology.

Figure 5A:
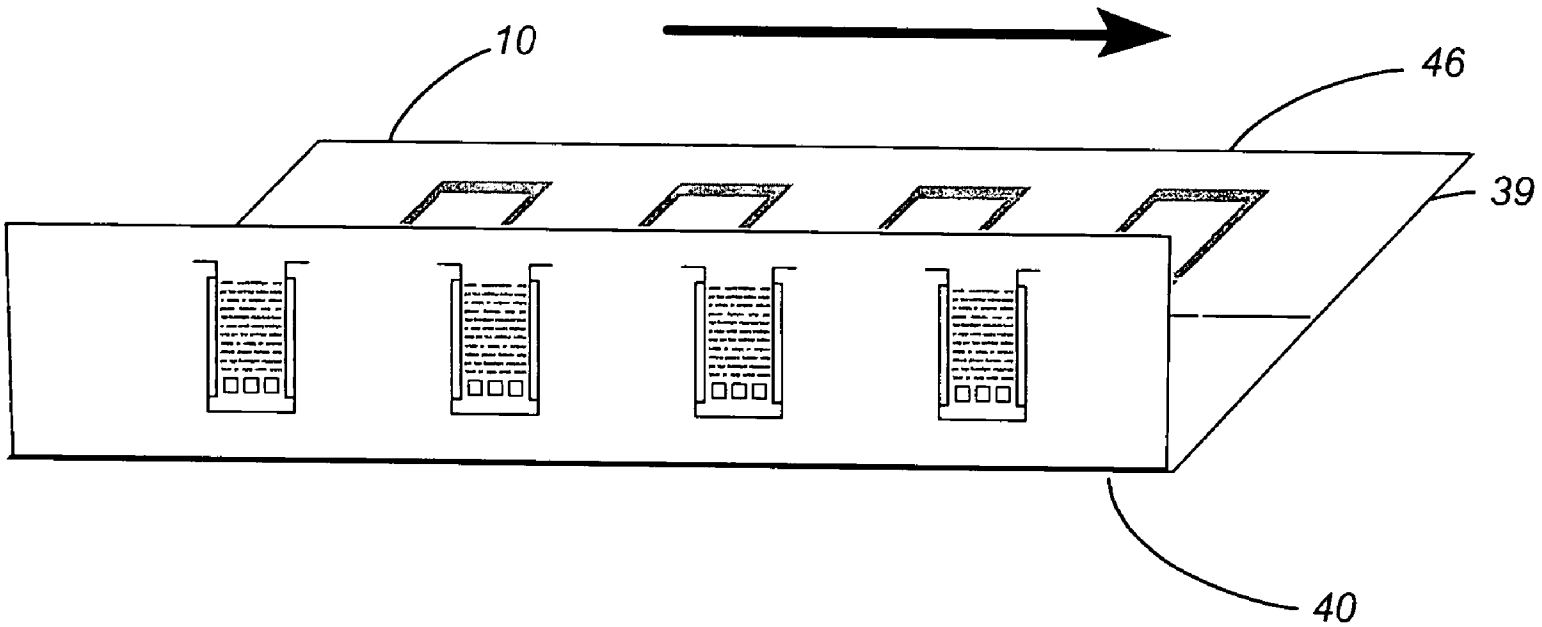
FIG. 5*a* is a plan view illustrating the first fold operation showing back of sheet indicia row D folded over onto row E, whereby the respective indicia of each said row is in intended alignment with the other.
Figure 5B:
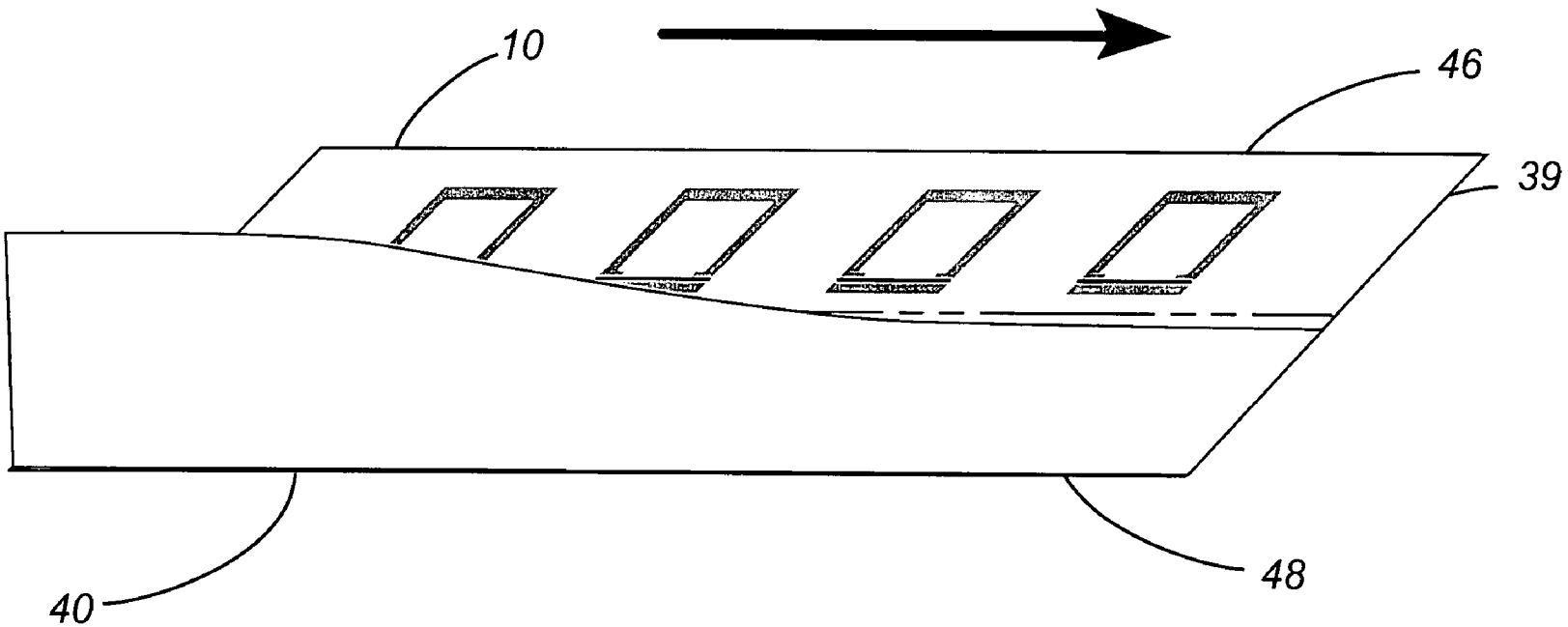
FIG. 5*b* is a plan view illustrating a second fold operation showing back of sheet indicia row F folded over onto row C.
Figure 6A:
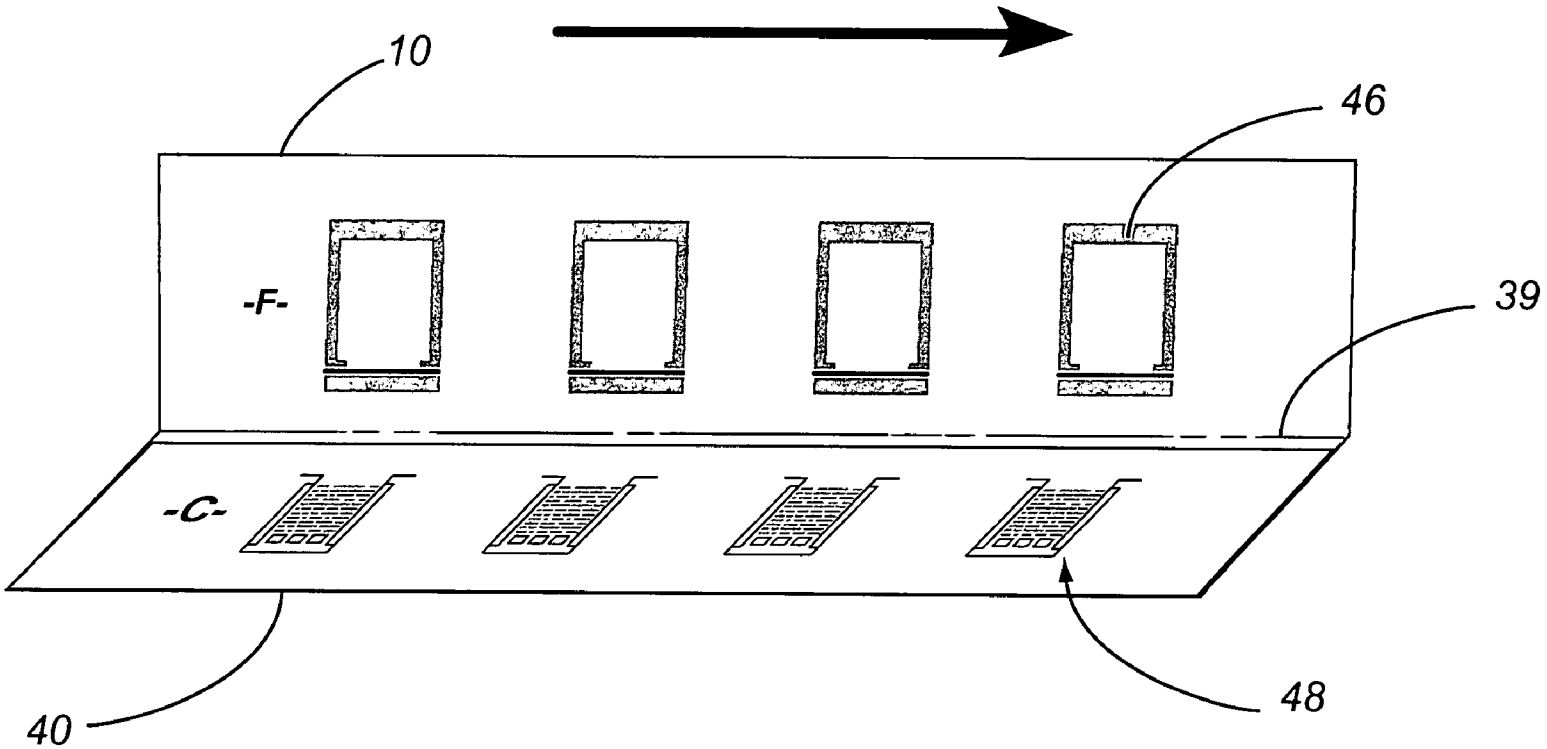
FIGS. 6A and 6B are plan views illustrating a third fold operation.
Figure 6B:
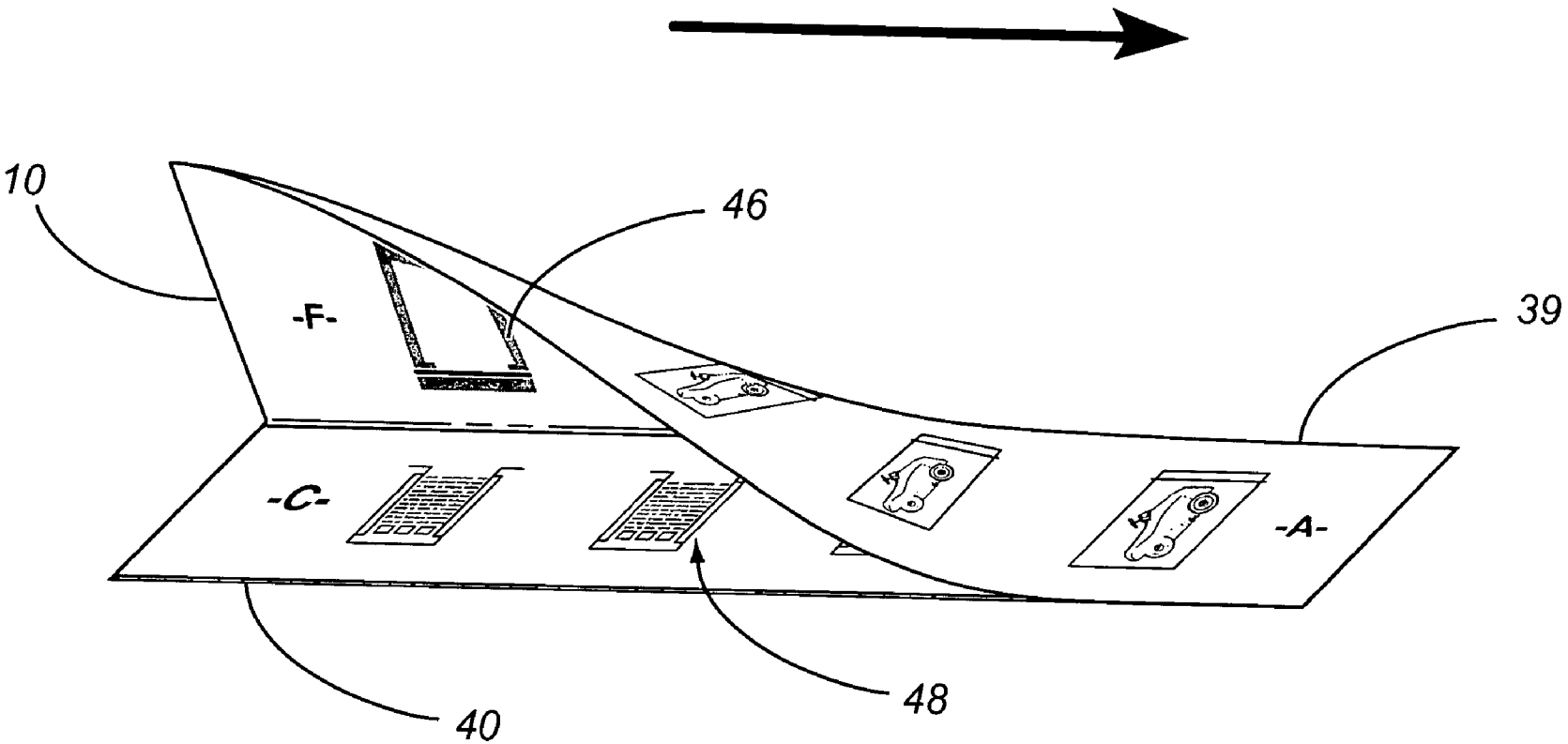
Figure 7:
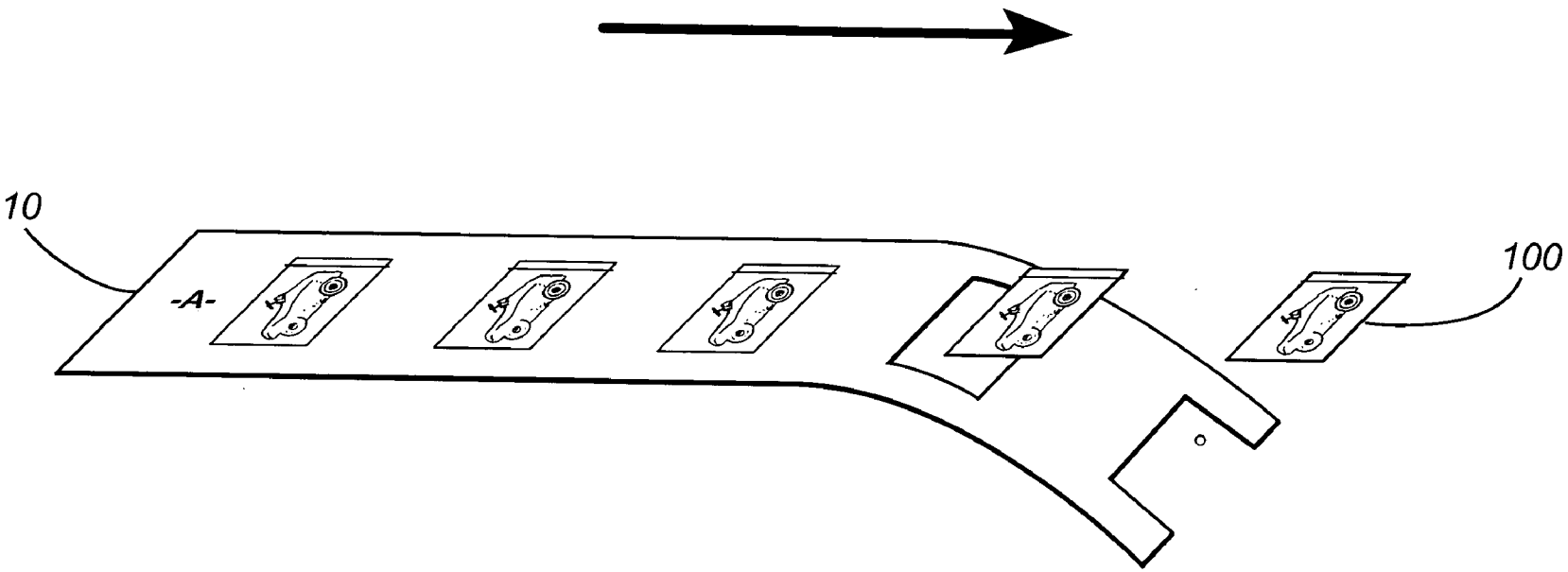
FIG. 7 illustrates a final die-cut operation whereby the final product is die-cut from the glued and folded sheet.

After the sheet is folded as shown in FIGS. 5*a,* through 6*b,* only rows A and B now define the front and rear of the resulting folded and affixed sheet as depicted in FIG. 7 with row B being on the rear side (not shown). As depicted in FIG. 7, the 6 layered and glued images are now die cut out from the three layered folded sheet 10 while ensuring that the previous die cut lines have their endpoints outside and centered to final die or rotary cuts.

Figure 8:
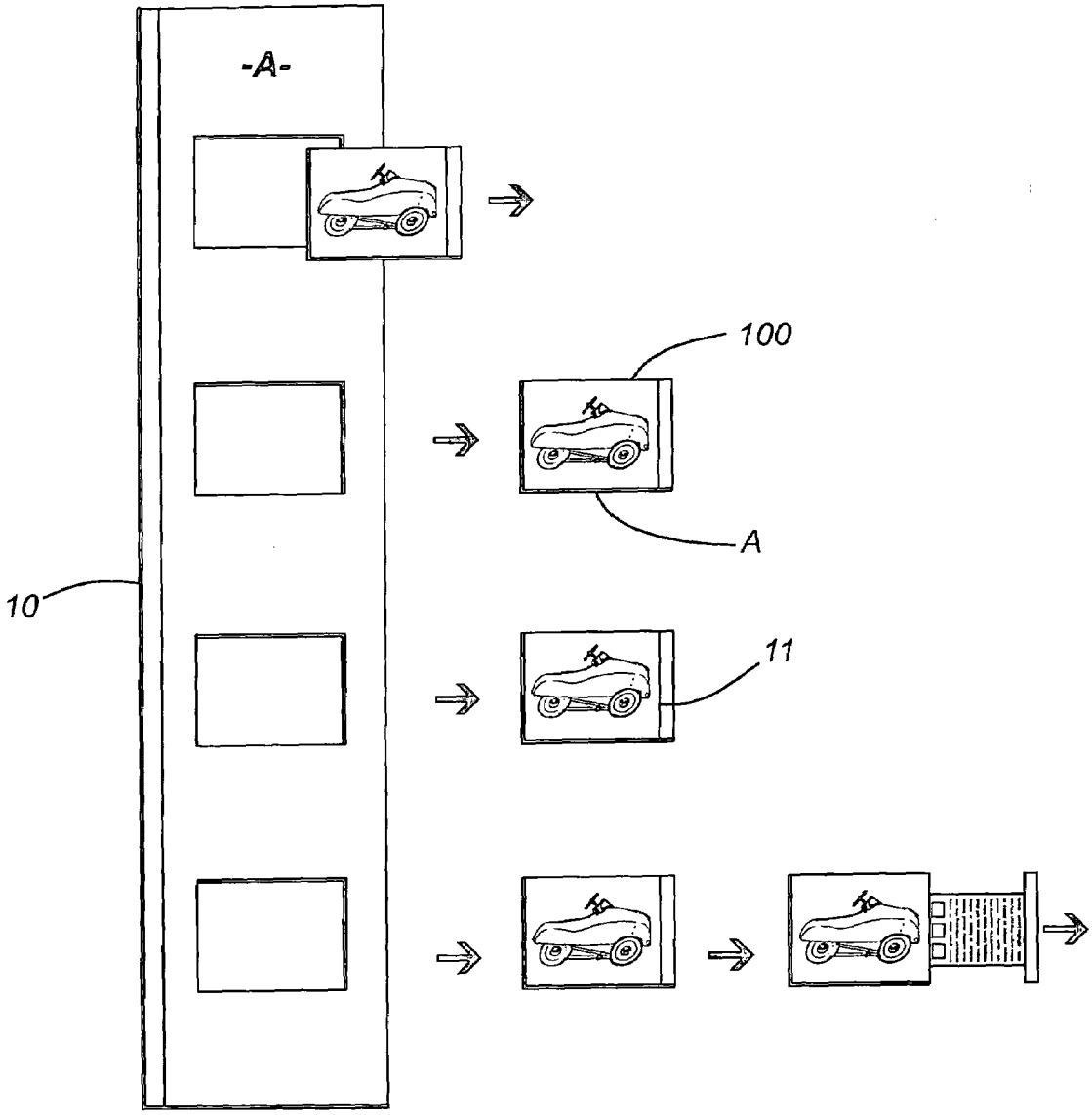
FIG. 8 illustrates the final piece showing faces A and B, and the slide out component with indicia on both sides.

It is to be understood that the final piece 100 (4 being formed from sheet 10 of the illustrated embodiment) is shown in FIG. 7 being die cut and releasing from the sheet 10. Piece 100 has a front face A, as seen in FIG. 8, die cut or perforated along line 11. By pulling the piece on the small side of the die cut 11 which defines a tab, comprised of three layers, the hidden indicia on rows C and D, now emerges and becomes visible, row C panel and indicia being visible when viewing the front face A, and row D panel and indicia being visible when viewing the back face B. The slide out central layer moves outward a predetermined distance, which is a product of the design intent. It could be a very short distance or a very substantial percentage of the overall width or length of the entire piece. Piece 100 also has a back face, B, (not visible in FIG. 8.) but nonetheless on the opposite side of front face A, and in alignment and registration with all of the other rows.

There is thus described a novelty piece which has moveable display and a method for making the same on sheet fed printing equipment. Obviously, variations thereof may occur to any artisan and the scope of the invention should only be considered to be limited by the scope of the appended claims. For example, it will be readily apparent to one skilled in the art that sets of different images can be produced on the same sheet and that the configuration of the novelty piece is not restricted to a rectangle, but can be produced in many geometrical shape variations, and as well the number of sliding components need not be restricted to one, but there can be any number of sliding components, limited only by the size of the overall piece.

The invention claimed is:

1. A method for forming a novelty piece comprising the steps of:

(A) imprinting a first face with at least a single row of spaced indicia on a continuous roll of printable material;

(B) cutting a plurality of lines on said continous roll to correspond with a desired configuration of a sliding member and removing a portion of material from each individual sliding member to provide a pre-determined course of movement;

(C) forming a pair of fold lines which divide said continuous roll into at least three portions;

(D) applying adhesive at pre-determined locations on said continuous roll so as to create an enclosure to restrain and direct the movement of said sliding member;

folding said continuous roll along said pairs of fold lines so as to form a housing portion from said portions;

(E) cutting out said folded and adhesively secured indicia and said sliding members, thereby forming said novelty piece.

2. The method of claim 1 wherein Step A, at least a portion of the spaced indicia is cut so as to provide a window, which can be used to selectively expose other indicia, applied to said sliding member or the interior of said housing.

3. The method of claim 1, wherein spaced indicia is also applied to a second row.

4. The method of claim 1, wherein spaced indicia is also applied to a third row.

5. The method of claim 4, wherein the spaced indicia applied to the third row is a portion of a total illustration with the remainder thereof applied to a row on the opposite side of said continuous roll.

* * * * *